US005370220A

United States Patent [19]

Wang

[11] Patent Number: 5,370,220

[45] Date of Patent: Dec. 6, 1994

[54] ARTICLE DISPLAY AND DISPENSING CONTAINER WITH VERTICAL TROUGHS

[76] Inventor: Hsu-Yi Wang, No. 3 Alley 17, Chung Cheng Rd, Pei Tou, Taipei, Taiwan, Prov. of China

[21] Appl. No.: 135,396

[22] Filed: Oct. 13, 1993

[51] Int. Cl.[5] ..... B65D 75/58; B65D 85/62

[52] U.S. Cl. ..... 206/44.12; 206/499; 206/806; 221/305; 312/42

[58] Field of Search ..... 206/44.12, 45.12, 499, 206/806; 221/194, 302, 305, 92, 312 R; 312/42, 60, 71; 211/59.2

[56] References Cited

U.S. PATENT DOCUMENTS

| | | | |
|---|---|---|---|
| 487,026 | 11/1892 | Cummings | 206/493 |
| 1,620,808 | 3/1927 | Eldridge | 312/42 |
| 1,628,439 | 5/1927 | Staubly | 221/305 X |
| 1,663,088 | 3/1928 | Matheson | 312/42 |
| 1,725,372 | 8/1929 | Richman | 206/44.12 X |
| 1,904,760 | 4/1933 | Matheson | 312/42 |
| 1,972,406 | 9/1934 | Marsh | 221/305 |
| 1,999,021 | 4/1935 | Marsh | 312/42 X |
| 3,002,651 | 10/1961 | Gould | 206/499 X |
| 3,066,843 | 12/1962 | Johnson | 206/44.12 X |
| 3,309,206 | 3/1967 | Daniels | 206/499 X |

*Primary Examiner*—Bryon P. Gehman

*Attorney, Agent, or Firm*—Morton J. Rosenberg; David I. Klein

[57] ABSTRACT

The invention relates to a hanging type of an article display and dispensing system. The invention directs itself to a frame container including an underboard frame and outer container which may be hung on a wall and allows easy removal of articles therein.

2 Claims, 5 Drawing Sheets

ARTICLE DISPLAY AND DISPENSING CONTAINER WITH VERTICAL TROUGHS

BACKGROUND OF THE INVENTION

1. Field of the Invention

The present invention relates to a hanging type of an article display and dispensing system. In particular, this invention directs itself to a frame container including an underboard frame and outer container which may be hung on a wall and easily allow removal of articles therein.

2. Description of the Prior Art

In some prior art utilizations, products may be separately and individually provided on display stands. This type of article display has been the custom for numbers of years. This manner of selling packaged products is inefficient with respect to volume considerations and is aesthetically unappealing while inconveniencing the user. Merchants must pile the packaged products up when selling the merchandise. Thus, merchandise located at the top of a pile may be easy to remove, while the lower merchandise may cause the consumer problems. This is inconvenient for purchasers and is also not the optimum way to display the merchandise. When customers bring the packaged boxes of merchandise home, such are generally stored in a stacked configuration and removal causes the same problem as merchants encounter. Furthermore, such prior art does not allow for display advertising. Manufacturers prefer to print merchandising terms or drawings on the outside of packing boxes to attract customers. Traditionally, prior art horizontal packing boxes only are printed on the outside surface of the box. It is generally preferred that display indicia be printed on a plane hanger sheet 4 formed on one side of the box as shown in one prior art packing box of FIG. 5. This prior art type of packing box cannot be mounted one upon the other for the merchandise drawings may be covered and occupy too much volume resulting in economic inefficiency. Moreover, merchants must exert themselves to remove merchandise individually, then hang them back on a wall. Additionally, packing boxes of smaller dimensions do not have enough surface area to allow sufficient printing on the merchandise boxes. The present packing mode for smaller merchandise uses paper sheets to adapt plastic case packing shaped in a vacuum, showing merchandise packed therein to customers through transparent plastic covering materials. However, such increases the cost of packing and meets resistance from environmental protection movements in the use of plastic materials. Due to these disadvantages, the subject invention has been devised to improve the packing and display of merchandise, and is adapted to the concept of environmental protection as well as the economic efficiency of packing costs.

SUMMARY OF THE INVENTION

The main object of this invention is to provide a hanging type of article display and dispensing box with cut or score lines cut in advance under the surface of the box body to form a removable shelter strip which can be torn away to form an aperture inside the box body, underboards with several internal grooves formed therein are installed for stacking merchandise. The merchandise which is located at the lowest section of the internal underboards may be removed through the aperture of the box body and then the upper merchandise moves automatically to lower ranks for accommodating a next article removal.

Another object of this invention is to provide a hanging type of packing display box with an internal box which may be used as a display box. In this way, increased printing areas for merchandising are provided and the advertising effect and unit value is optimized. Additionally, promoting environmental protection is realized as the entire system is made of paper, which optimizes the protection of natural resources.

DETAILED DESCRIPTION OF THE INVENTION

Figure 1:
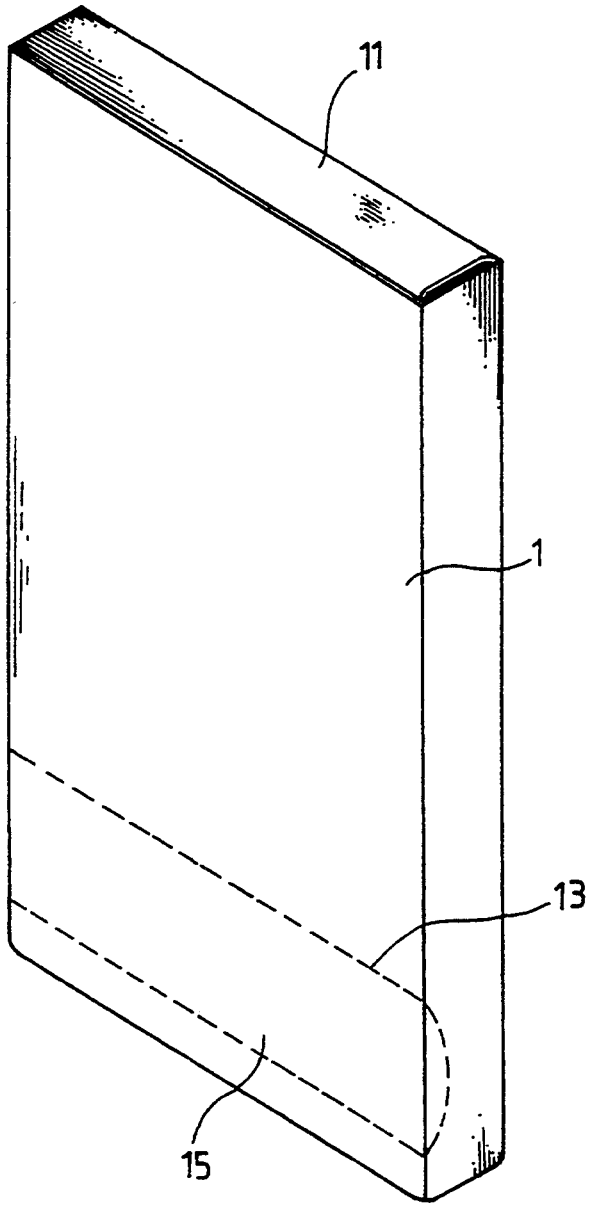
FIG. 1 is a perspective view of the article display and dispensing system of this invention concept in a closed state.
Figure 2:
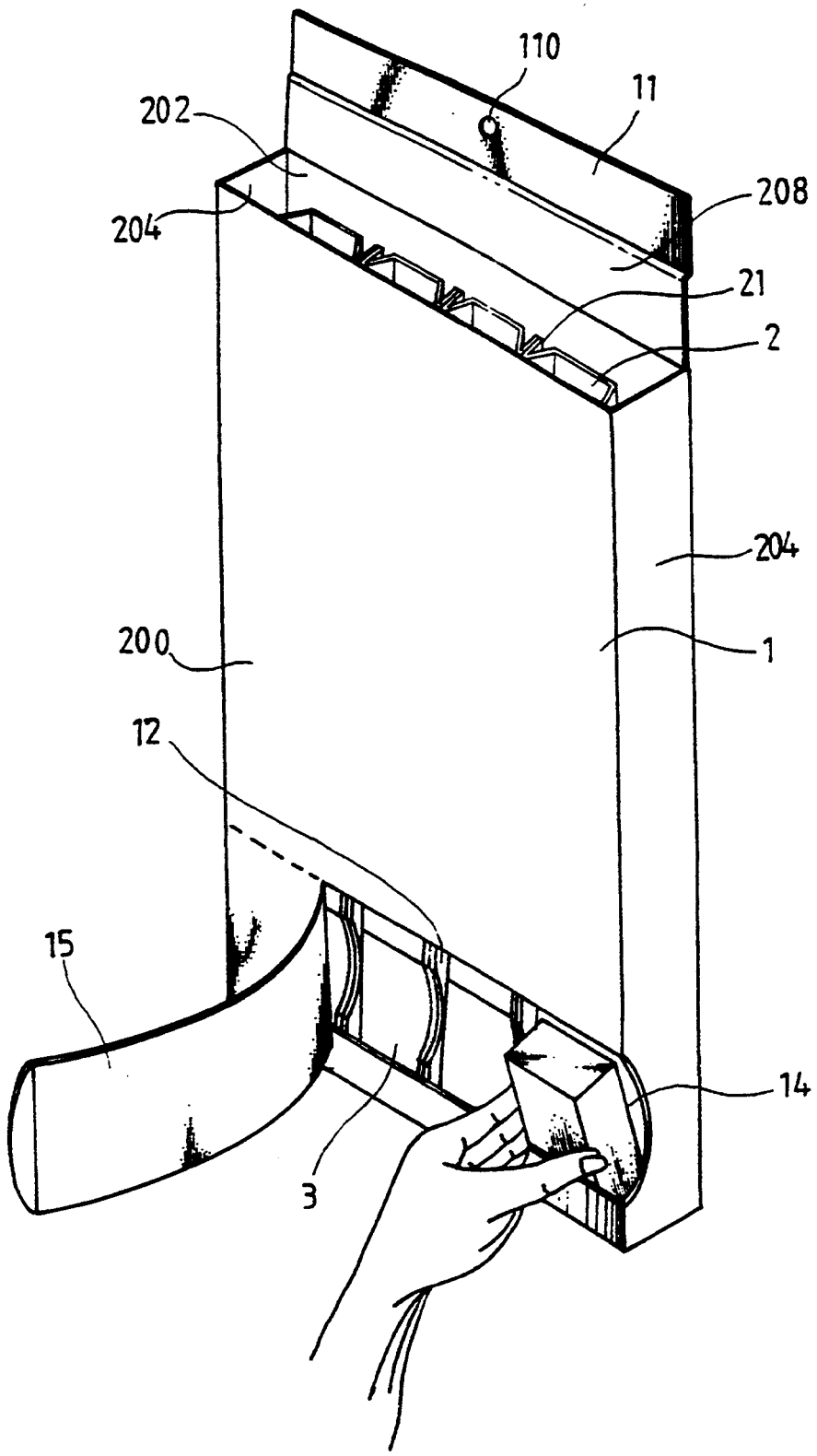
FIG. 2 is a perspective view of the article display and dispensing system being opened.
Figure 3:
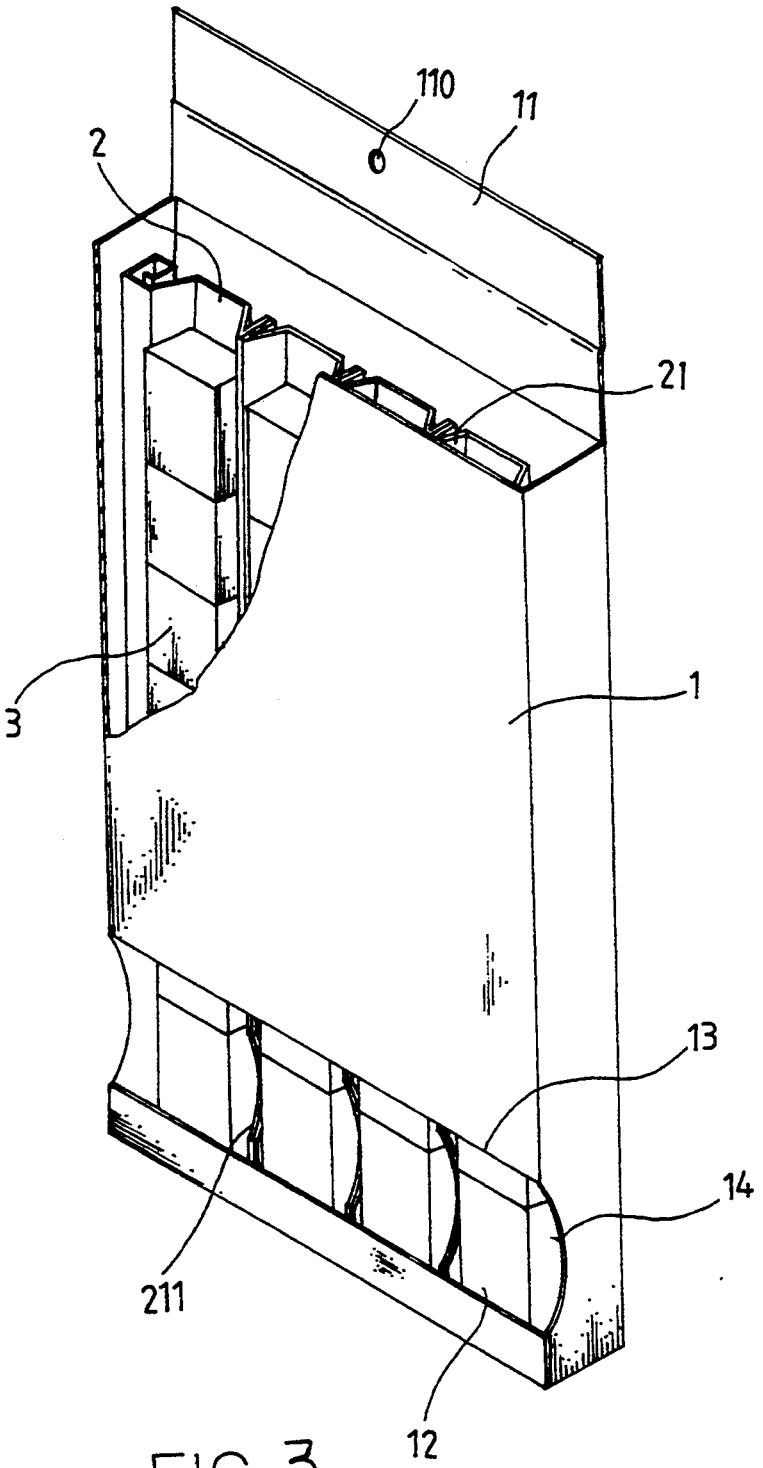
FIG. 3 is a perspective view of the subject system in an operational state.
Figure 4:
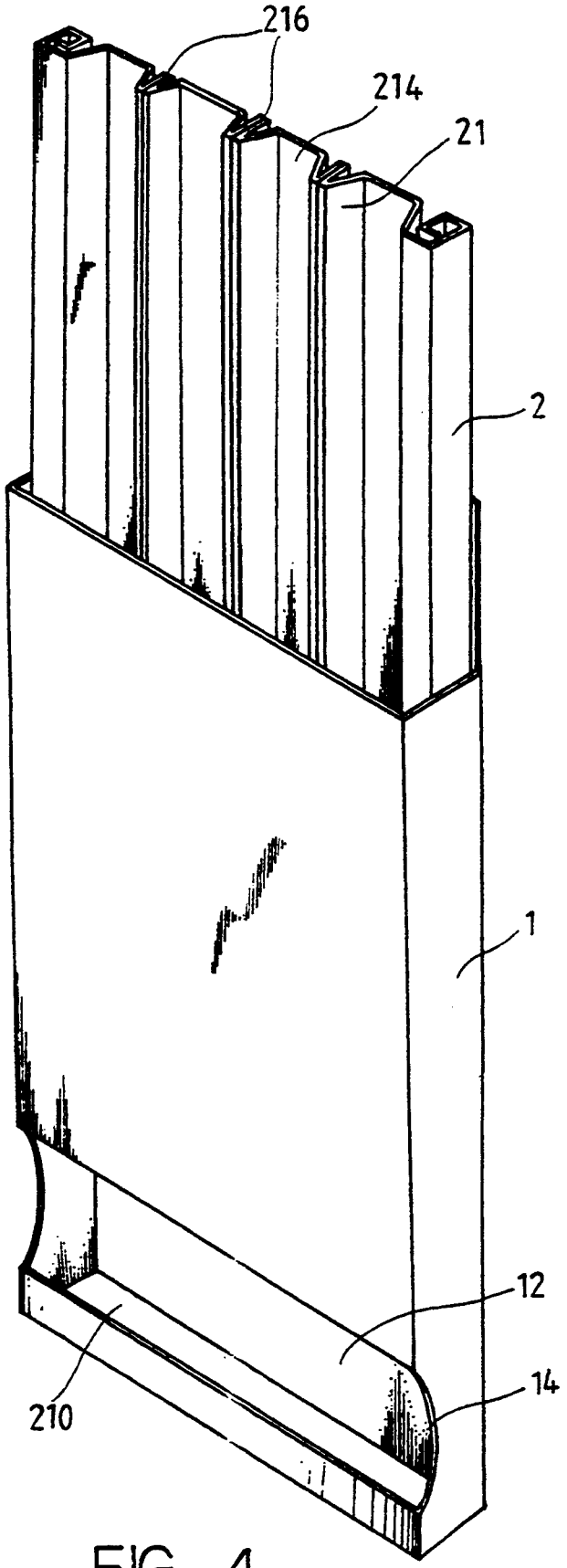
FIG. 4 is a perspective view of the subject system showing insert of internal underboards; and, FIG. 5 is a perspective view of a prior art packing box.
Figure 5:
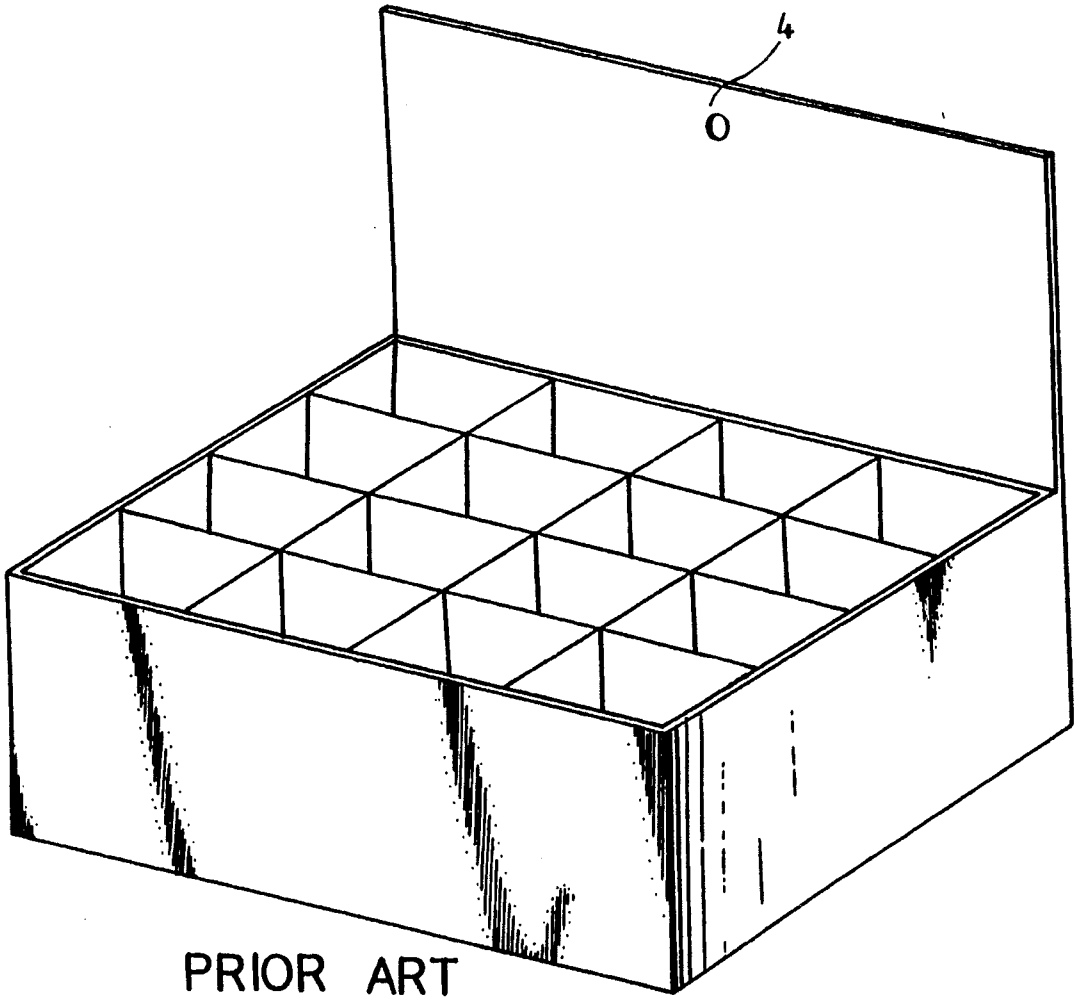
PRIOR ART FIG. 5

Referring now to FIG. 1, there is shown the container system of the present invention being formed of a paper material folded into closed contour. The container system includes outer container or box body 1 formed by a frontal panel 200, a rear panel 202, opposing side panels 204 and 206, as well as top and bottom panels 208 and 210. On a lower section of frontal panel 200 are formed cut marks or scored lines 13 cut in advance to form a removable shelter strip 15. The shelter strip 15 extends to the arcuate scored lines on opposing sidewalls 204 and 206. Grooves or arcuate recesses 14 are formed within the border on both sides of outer container or box body 1 and the shelter strip 15. Shelter strip 15 can be removed to allow insert of a user's fingers to remove merchandise or articles 3 as shown in FIG. 2. The torn shelter strip 15 forms an aperture 12 to provide access internal the box body 1. At the upper section of the box body 1 is a covered cap 11 and top panel 208 which can be bent. Through the covered cap 11 is formed a hole or bore 110. The box body 1 can be covered by the covered cap 11, or alternatively may be hung on a nail on a wall when the covered cap 11 is uncovered from the body 1. Underboards with several internal grooves 2 which are made of paper are adapted to be inserted internal box body 1, as shown in FIG. 4. Each underboard is generally U-shaped in contour having an underboard base 214 and a pair of inclined side panels defining a tapered trough shaped contour. On the other side of the underboards, inclining to the side walls 21, are plane sheets or underboard side panels 216 forming a suitable included angle with the side walls 21. The side walls 21 are flexibly enhanced by each plane sheet 216 in contiguous planar contact with a next planar sheet. In this way, the box body will not be deformed even though merchandise are impact loaded. On a lower section of each side wall 21 is a shaped internal concave recess 211 for insert of a user's fingers to remove the lowest positioned merchandise 3 through the aperture 12 within the box body 1. Upper positioned merchandise automatically displaces to a lower rank by gravity for a next removal, as shown in FIG. 3. This type of structure offers larger surface areas for packing boxes, provides enhanced visual effects for merchandising, and makes a deeper impression on consumers. Furthermore, this invention combines an internal box with a display box, which may be hung to prevent the disadvantages associated with taking out merchandise from a hanger singly and to further make it easier to hang the box body on a hanger. Due to the larger surface area of the box body, such increases the merchandising effect and optimizes the time, transport cost and packing cost for the display of merchandise to be sold. Moreover, the packing box is formed totally devoid of plastic material which promotes environmental protection concepts.

I claim:

1. An article display and dispensing container system comprising:

(a) an outer container extending in a vertical longitudinal direction and transverse direction including a frontal panel and a rear panel displaced each from the other and joined each to the other by a pair of transversely displaced side panels, said outer container further including a top panel hingedly coupled to an upper section of said rear panel and a bottom panel secured to lower sections of said frontal, rear and side panels, a plurality of score lines extending transversely in the lower section of the frontal panel, said score lines further extending arcuately in at least one of said sidewalls defining a removable shelter strip member for forming an article removing aperture when said shelter strip member is removed from said frontal panel; and, (b) a plurality of vertically directed underboard members adjacently located within said outer container, each of said underboard members having a generally U-shaped cross-sectional contour forming an underboard base member and a pair of transversely inclined underboard sidewalls forming a vertically directed inclined wall trough for insert of articles therein, articles being mounted one upon the other within said inclined wall troughs for removal through said article removing aperture, each of said underboard member sidewalls having an arcuate recess formed therein within a lower section thereof for ease of removal of said articles.

2. The article display and dispensing container system as recited in claim 1 wherein at least one of said underboard members includes a pair of planar underboard side panels secured to said inclined underboard sidewalls throughout a vertical length of said underboard members for contiguous interface with a planar underboard side panel of an adjacent underboard member.

* * * * *